US006774847B1

(12) United States Patent
Epstein et al.

(10) Patent No.: US 6,774,847 B1
(45) Date of Patent: Aug. 10, 2004

(54) SYSTEM AND METHOD PROVIDING INTEGRATED CHIP ANTENNA WITH DISPLAY FOR COMMUNICATIONS DEVICES

(75) Inventors: Norman Epstein, St. Lucie West, FL (US); Robert Vu, Houston, TX (US)

(73) Assignee: Symbol Technologies, Inc., Holtsville, NY (US)

( * ) Notice: Subject to any disclaimer, the term of this patent is extended or adjusted under 35 U.S.C. 154(b) by 9 days.

(21) Appl. No.: 10/085,537

(22) Filed: Feb. 28, 2002

Related U.S. Application Data

(60) Provisional application No. 60/272,684, filed on Mar. 1, 2001.

(51) Int. Cl.[7] ..... H01Q 1/38

(52) U.S. Cl. ..... 343/700 MS; 343/787; 343/873

(58) Field of Search ..... 343/700 MS, 702, 343/787, 872, 873, 878, 895

(56) References Cited

U.S. PATENT DOCUMENTS

| | | | | | |
|---|---|---|---|---|---|
| 5,909,198 | A | * | 6/1999 | Mandai et al. | 343/895 |
| 5,986,614 | A | * | 11/1999 | Suesada et al. | 343/752 |
| 6,031,731 | A | * | 2/2000 | Suesada et al. | 361/800 |
| 6,442,399 | B1 | * | 8/2002 | Tsuru et al. | 455/550 |

* cited by examiner

*Primary Examiner*—Shih-Chao Chen
(74) *Attorney, Agent, or Firm*—Amin & Turocy, LLP

(57) ABSTRACT

A portable communications and display system and methodology is provided in accordance with the present invention. The system includes a chip antenna for transmitting and receiving RF signals, a lens material for mounting the chip antenna and a conductive material for providing a chip antenna ground plane. The conductive material provides an operative coupling between the lens material and the chip antenna. A communications subsystem is provided that is associated with the lens material and is operatively coupled to the chip antenna for processing the RF signals.

26 Claims, 7 Drawing Sheets

SIDE VIEW

TOP VIEW

SIDE VIEW

TOP VIEW

SYSTEM AND METHOD PROVIDING INTEGRATED CHIP ANTENNA WITH DISPLAY FOR COMMUNICATIONS DEVICES

REFERENCE TO RELATED APPLICATION

This application claims the benefit of U.S. Provisional Patent Application Serial No. 60/272,684, which was filed Mar. 1, 2001, entitled SYSTEM AND METHOD PROVIDING INTEGRATED CHIP ANTENNA WITH DISPLAY FOR COMMUNICATIONS DEVICES.

TECHNICAL FIELD

The present invention relates generally to Radio Frequency (RF) communications systems, and more particularly to a system and method providing a communications interface wherein an integrated chip antenna is employed in conjunction with a display to create an easily manufactured, lower cost communications system.

BACKGROUND OF THE INVENTION

Wireless communications systems have experienced rapid growth and technological innovation in recent years. Society has accepted and in some cases become dependent upon wireless technologies such as cellular phones and pagers for daily personal and professional communications. This has become possible by continual advancements in microelectronics and power technologies, which have aided in decreasing the size, weight and cost of these devices while increasing functionality. Many industrial and commercial applications have come to depend on wireless technologies as well. Factories, warehouses, retail establishments and service establishments (e.g., rental car agencies and utilities) have also come to depend on wireless technologies thereby enabling workers to be more productive and decreasing their overall costs. Inventory control stations, checkout or billing systems, pricing and labeling systems, automatic storage and retrieval systems and short-range employee communications systems are just a few examples of applications that benefit from wireless communications technology.

Wireless communication systems utilize several well-known components such as a receiver, transmitter and an antenna The receiver and transmitter, hereafter referred to as a communications module or subsystem, powers, filters, modulates and de-modulates associated communications signals, wherein the antenna is employed to receive and broadcast these signals. Antennas may be manufactured from many conductive materials, and are constructed according to the frequency of signal that is being received and/or broadcast. For example, a communications device that is receiving or broadcasting in the 400 megahertz frequency range will need a longer antenna than a comparable communications device receiving or broadcasting in the 900 megahertz frequency range due to the wavelength of the signal. There are many methods for constructing antennas and attaching them to communications modules in practice today. Many manufacturers install an externally mounted flexible rod, or whip antenna on their communications systems. These may be hard-wired into the communications module, or they may be detachable through techniques such as a threaded base. Devices that do not require long-range communications may have an internally mounted antenna such as a length of wire or coaxial cable. These and other methods of antenna construction and installation within a communications module are widely practiced and accepted, but each has drawbacks that render these techniques less than optimal.

Externally mounted antennas extend into the atmosphere from the communications device on which it is installed. The result is often less than aesthetically pleasing and has functional ramifications as well. Because of the protrusion of the antenna from the main body of the product, it is easy to catch or "snag" the device on stationary objects. If the communications device is dropped or placed without care, the antenna is likely to be affected due to its exposed installation. Impacts such as this will, over time, have the affect of distorting or damaging the antenna, thus changing the operating parameters. This could include a decrease in effective range, changing the desired operating signal frequency, and intermittent operation. The externally mounted antenna also creates challenges in manufacturing, as the method used to mount this type of antenna generally requires more parts and more machining processes, both of which will add labor, complexity and cost to the system.

Internally mounted wire or coaxial cable antenna, hereinafter referred to as a cable antenna, mitigates some of the problems associated with the exposed installation of an external antenna, but creates other obstacles in the process. Depending on the operating frequency, the cable required could be many inches in length, which may cause difficulty in securely placing and fastening the cable antenna within the communications device. Because of the highly flexible nature of cable antennas, it is difficult to uniformly place and fasten them in each communications device manufactured, thus operating differences from one communications device to another are common. Also, sudden movement of the communications device or impact with another object may displace the cable antenna from the desired mounted position, thus dramatically affecting the performance of the device. The manufacture of the cable antenna is generally a manual process, and thus control of the final operating parameters is less than optimal.

In view of the above problems associated with externally and/or internally mounted wire antennas, there is an unsolved need for a system and methodology to provide reliable, higher quality and lower cost communications devices to consumers.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention relates to a system and method providing a lower cost and higher reliability communications system utilizing an integrated chip antenna. The system employs chip antenna technology which may be coupled to a small printed circuit card or flexible circuit material, hereafter referred to as the circuit material, and a display lens for providing a ground plane for the chip antenna and a mounting surface for the circuit material. The present invention integrates the chip antenna technology and the display lens within a packaged communications module creating a reliable, and lower cost communications system. The communications system may include a receiver and/or transmitter, and may operate in suitable frequency ranges as provided by the chip antenna.

In accordance with the present invention, a chip antenna is operatively coupled to the circuit material. Chip antennas are generally small in size, and may be mounted to the circuit material through a surface mounting solder process. This process creates a substantially rigid, non-flexible connection to the circuit material. The circuit material is then mechanically adhered to and electrically isolated from the conductive surface of the display lens. The surface of the display lens is covered with a conductive material that is transparent to allow for viewing of the information on a display device driving the lens. The circuit material is etched to allow for electrical coupling of the chip antenna to the circuitry within the communications module. The display lens provides an electrically isolated access through or around the conductive surface of the lens to the circuitry contained within the communications module. Coupling of the chip antenna circuit to the communication circuitry may be achieved through mating connectors or direct connection of a flexible circuit material into the communication module circuit, as well other techniques employed in accordance with the present invention.

According to one aspect of the present invention, a portable communications and display system is provided. The system includes a chip antenna for transmitting and receiving RF signals and a lens material for mounting the chip antenna. A conductive material provides a chip antenna ground plane, wherein the conductive material provides an operative coupling between the lens material and the chip antenna. A communications subsystem is associated with the lens material and is operatively coupled to the chip antenna for processing the RF signals.

In accordance with another aspect of the present invention, a method is provided for portable communications and display. The method includes: utilizing a chip antenna for transmitting and receiving RF signals; applying a conductive material to a lens material to provide a ground plane for the chip antenna; mounting the chip antenna to the conductive material and lens material; and coupling the chip antenna to a communications subsystem that is associated with the lens material for processing the RF signals.

According to another aspect of the present invention, a system is provided for portable communications and display. The system includes: a chip antenna for transmitting and receiving RF signals; means for coating a lens material to provide a ground plane for the chip antenna; means for mounting the chip antenna to the lens material; and means for coupling the chip antenna to a communications subsystem that is associated with the lens material for processing the RF signals.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other advantages and novel features of the invention will become apparent from the following detailed description of the invention when considered in conjunction with the drawings

DETAILED DESCRIPTION OF THE INVENTION

The present invention provides a system and methodology for creating a compact, reliable, low cost communications system through integration of a chip antenna, display lens and associated communications module. The chip antenna is protected from external elements, and is coupled to the display lens of the communications module. This prevents movement of the relative position of the antenna in relation to the communications module, facilitates consistent performance from one communications module to another, and decreases the probability of performance degradation due to sudden movements of or mechanical shock to the communications module.

Figure 1:
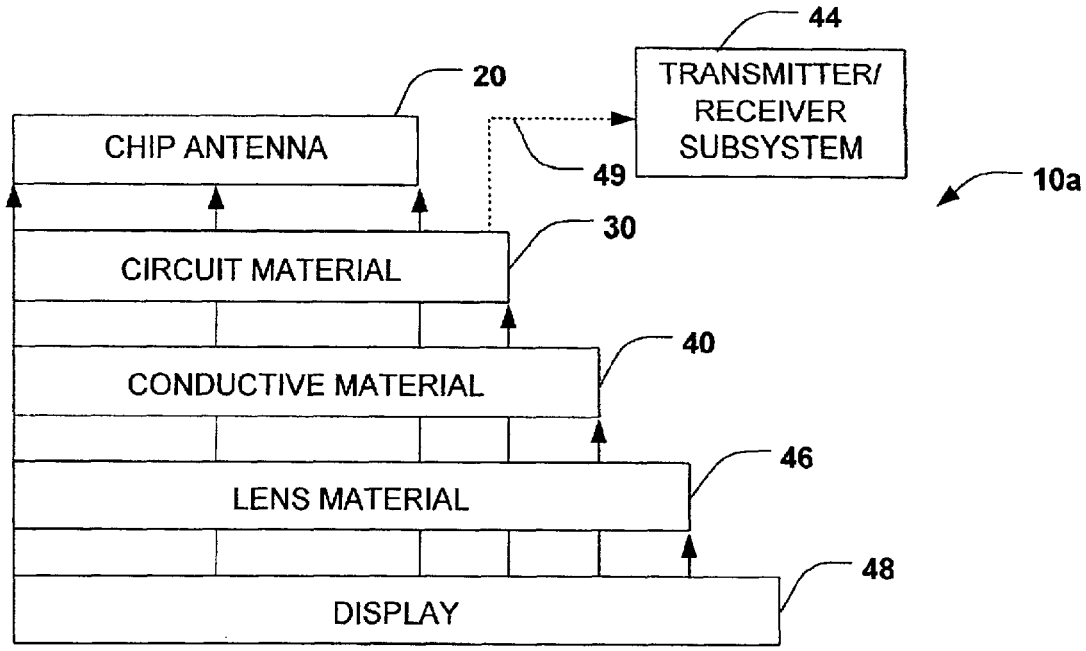
FIG. 1 is a schematic block diagram illustrating a communications system with an integrated antenna and display in accordance with an aspect of the present invention.
Figure 1:
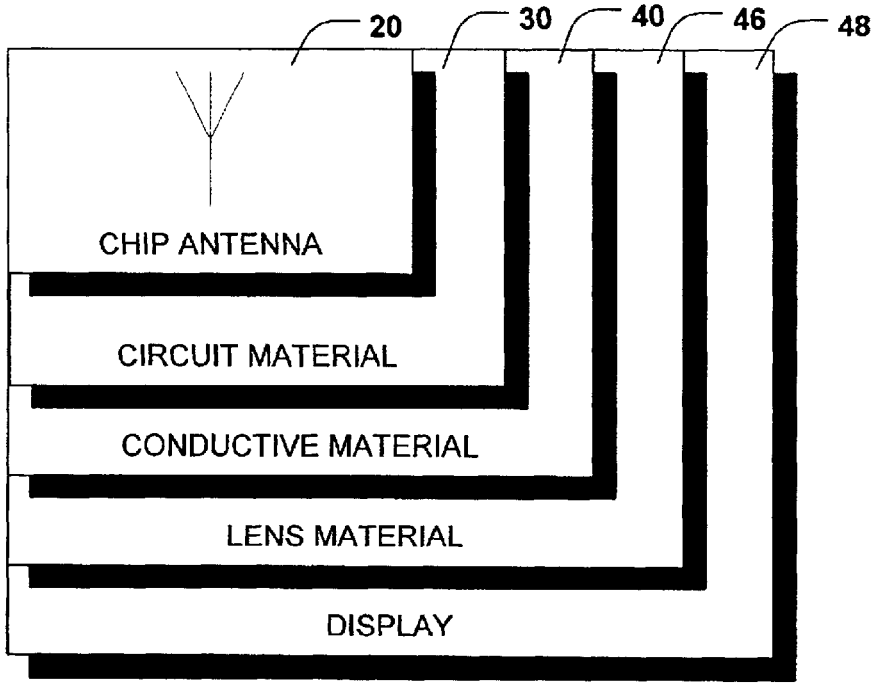

Referring initially to FIG. 1, a hand-held or portable communications system 10*a* is depicted which includes a chip antenna 20, circuit material 30, a conductive material 40, a communications subsystem such as a transmitter and/or receiver subsystem 44 (e.g., wireless transceiver), a lens material 46 and a display 48. FIG. 1 illustrates a side view and a top view of respective antenna, circuit material, and display configurations in accordance with the present invention. Referring to the side view of the communications system 10*a*, the chip antenna 20 is operatively coupled to the circuit material 30 that is affixed to the conductive material 40. The circuit material 30 provides an operative connection to the conductive material 40 wherein the conductive material 40 provides a ground connection and/or plane for the chip antenna 20. A signal connection 49 operatively couples a received or transmitted RF signal (not shown) from the chip antenna 20 to the transmitter/receiver subsystem 44.

The transmitter/receiver subsystem 44 can be substantially any well-known communications interface for transmitting and/or receiving RF signals and providing subsequent RF signal processing. These interfaces may include cell-phones, pagers, Personal Digital Assistants (PDA), scanners (e.g., bar code) and hand-held or portable computers such as Palm Pilots. By utilizing the chip antenna 20 and display 48 in accordance with the present invention, problems associated with mounting and construction of exterior/interior wire antennas in conjunction with portable communications devices are mitigated. Moreover, the chip antenna 20 generally provides for lower costs and higher reliability operation than with conventional wire antenna systems.

Referring now to the top view of the communications system 10*a* in FIG. 1, it can be observed that the chip antenna 20 is mounted upon the circuit material 30. The chip antenna 20 and circuit material 30 are then mounted upon the conductive material 40 to complete the signal transmitting/receiving portions of the communications system 10*a*. It is noted that the size relationship of chip antenna 20 and circuit material 30 to the conductive material 40 is not to scale in FIG. 1. It is understood that the size relationship is dependent upon the desired frequency range of the chip antenna 20. For example, the conductive material 40 and associated lens material 46 may be substantially any size, but generally not smaller than is required to create a ground plane for the chip antenna 20. For example, when coupled with chip antennas that operate in the four hundred (400) megahertz to twenty-four hundred (2400) megahertz range, the ground plane will be about ten (10) to thirty (30) times the size of the chip antenna. It is also noted that the relative placement of chip antenna 20 and circuit material 30 in reference to conductive material 40 and lens 46 is for clarity of illustration. It is to be appreciated that the chip antenna 20 may be placed at any suitable location on circuit material 30, and that circuit material 30 may be placed at any suitable location on the conductive material 40 and lens 46.

The conductive material 40 that is utilized as the ground plane for chip antenna 20 can be substantially any conductive coating, treatment, film and/or screen mesh that is transparent/translucent to enable an unobstructed view of the display 48 through the lens material 46. The lens material 46 is employed as a protective barrier for the display 48. Many different materials may be employed in the construction of lenses, including but not limited to glass, Plexiglas and plastic, for example. The display 48 is employed to provide information that is related to the function of a communications module or device. The display 48 may be a liquid crystal display (LCD), cathode ray tube (CRT) or TFT panel, for example.

Figure 2:
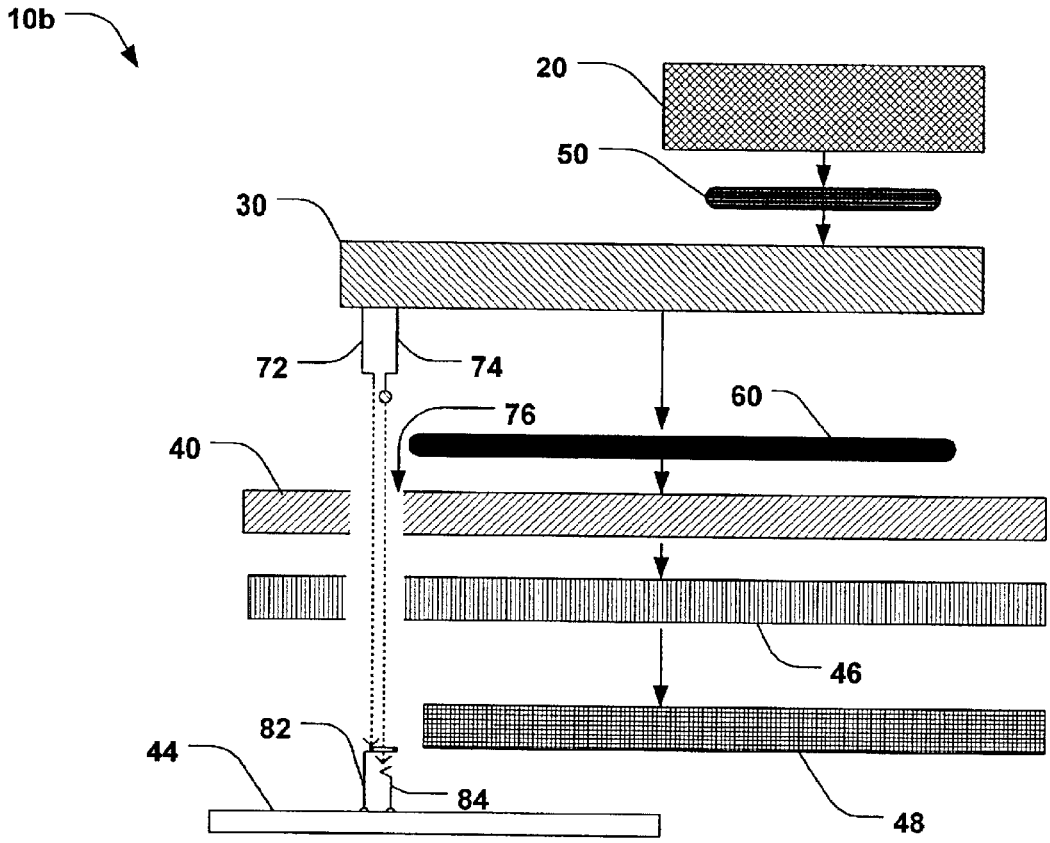
FIG. 2 is a schematic block diagram illustrating a communications system with an integrated antenna and display utilizing a pass-thru connection in accordance with an aspect of the present invention.

Turning now to FIG. 2, a communications system 10*b* illustrates an aspect of an exemplary chip antenna configuration and display in accordance with the present invention. The chip antenna 20 is coupled to circuit material 30 via solder connection 50. According to this aspect of the invention, the circuit material 30 is in the form of a substantially rigid printed circuit card, and is coupled to the conductive material 40 via a nonconductive adhesive 60. The circuit material 30 is coupled to the transmitter/receiver subsystem 44 via mating connectors 72 and 74 through an opening 76 in the conductive material 40 and lens material 46. Although not shown in FIG. 2, the display 48 may also be provided with an opening wherein a coupling may be achieved from the circuit material 30 to the transmitter/receiver subsystem 44. The opening 76 may be placed in any location on the conductive material 40 and lens material 46 that will facilitate the coupling of circuit material 30 and the transmitter/receiver subsystem 44. The transmitter/receiver subsystem 44 includes mating connections 82 and 84 respectively for coupling to connectors 72 and 74, wherein mating connector 82 provides a ground connection and mating connecting 84 provides an RF signal connection from the chip antenna 20 to the transmitter/receiver subsystem 44. The connectors 72, 74, 82 and 84 may be commercially available connectors, custom designed connectors and/or provided by coupling wires to both the circuit material 30 and the transmitter/receiver circuit 44. It is noted that the circuit material 30 is etched and/or fabricated such that there is an electrical coupling between the chip antenna 20 and mating connectors 72 and 74.

Figure 3:
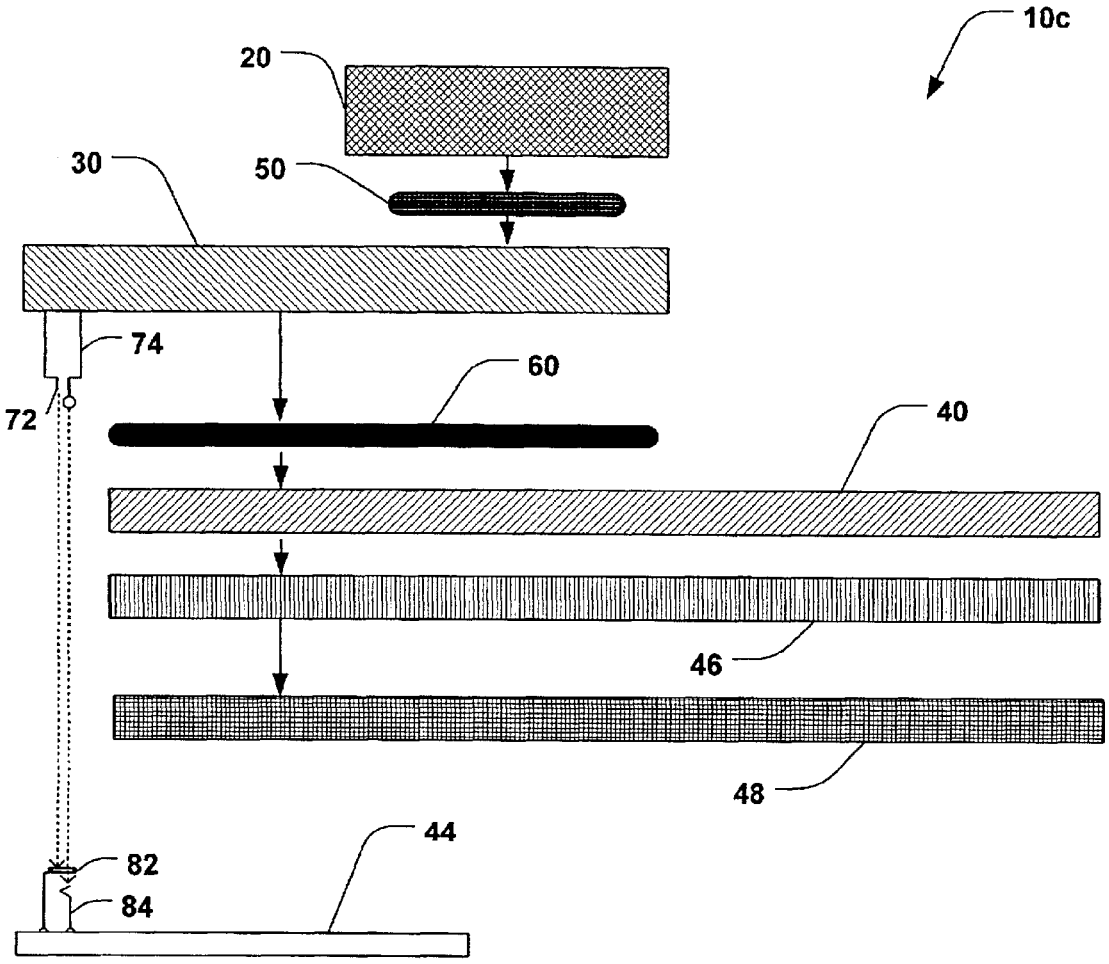
FIG. 3 is a schematic block diagram illustrating a communications system with an integrated antenna and display utilizing a pass-over connection in accordance with an aspect of the present invention.

Referring to FIG. 3, a communications system 10*c* illustrates an alternative chip antenna and display in accordance with the present invention. The communications system 10*c* is similar to the communications system 10*b* described above with the exception of the placement of circuit material 30 with respect to conductive material 40 and lens material 46. According to this aspect of the invention, the circuit material 30 is placed such that mating connectors 72 and 74 are outside of the outer edge of conductive material 40, lens material 46 and display 48. This enables coupling of circuit material 30 to the transmitter/receiver subsystem 44 without an opening in the conductive material 40 and lens material 45. Applications which do not have stringent space requirements may employ this configuration, as the manufacturing requirements are less demanding mitigating the need for openings in conductive material 40 and lens material 45. The display 48 in this configuration may be placed such that it extends to the outer edge of lens material 45 and conductive material 40. This enables a larger available viewing area of the display 48.

Figure 4:
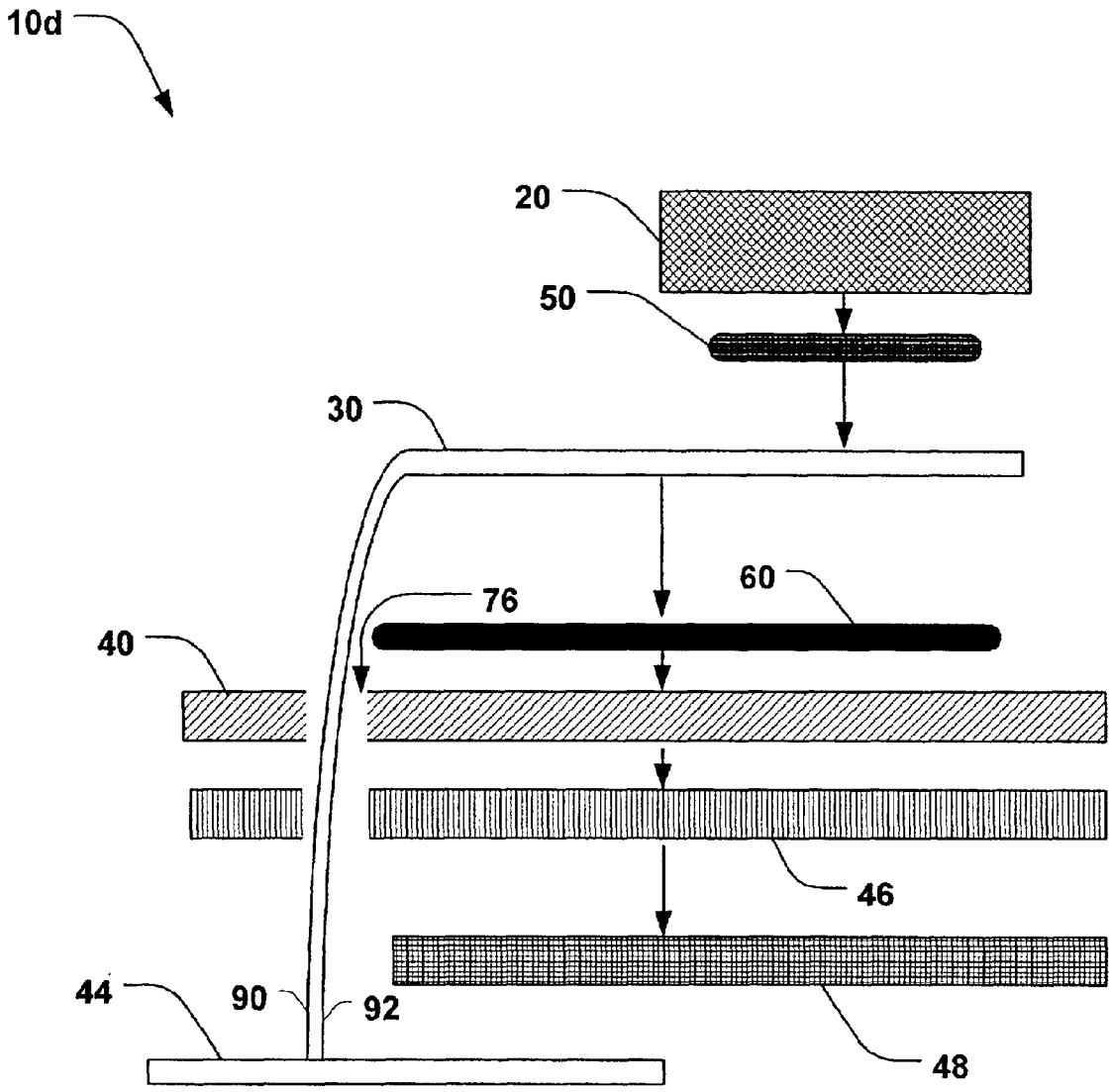
FIG. 4 is a schematic block diagram illustrating a communications system with an integrated antenna and display utilizing a flexible circuit material pass-thru connection in accordance with an aspect of the present invention.
Figure 5:
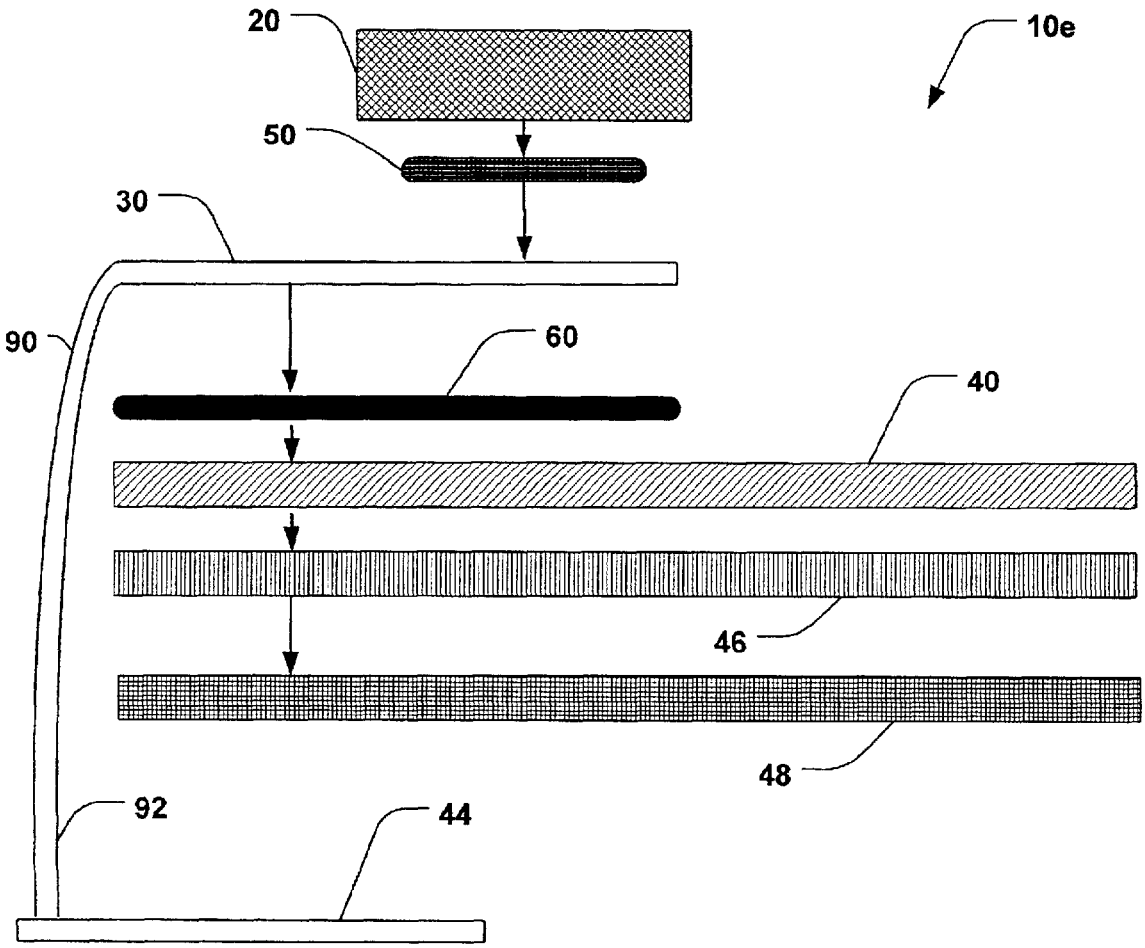
FIG. 5 is a schematic block diagram illustrating a communications system with an integrated antenna and display utilizing a flexible circuit material pass-over connection in accordance with an aspect of the present invention.

Referring now to FIGS. 4 and 5, a system 10*d* and 10*e* illustrates an alternative circuit material, coupling and configuration in accordance with the present invention. The chip antenna 20 is coupled to circuit material 30 via solder connection 50, as described above. According to this aspect of the invention, the circuit material 30 is in the form of a flexible circuit strip or material, and is coupled to the conductive material 40 via a non-conductive adhesive 60. The circuit material 30 is operatively coupled to the transmitter/receiver subsystem 44 via flexible connections 90 and 92 that are provided as part of the flexible circuit material 30. As described above, the circuit material 30 is etched or fabricated such that there is an electrical coupling between chip antenna 20 and connections 90 and 92. Referring to FIG. 5, the communications system 10*e* is similar to communications system 10*d* with the exception of the coupling of the circuit material 30. According to this aspect of the invention, the circuit material 30 is coupled on the outside of the conductive material 40, lens material 46, and display 48 as illustrated.

Figure 6:
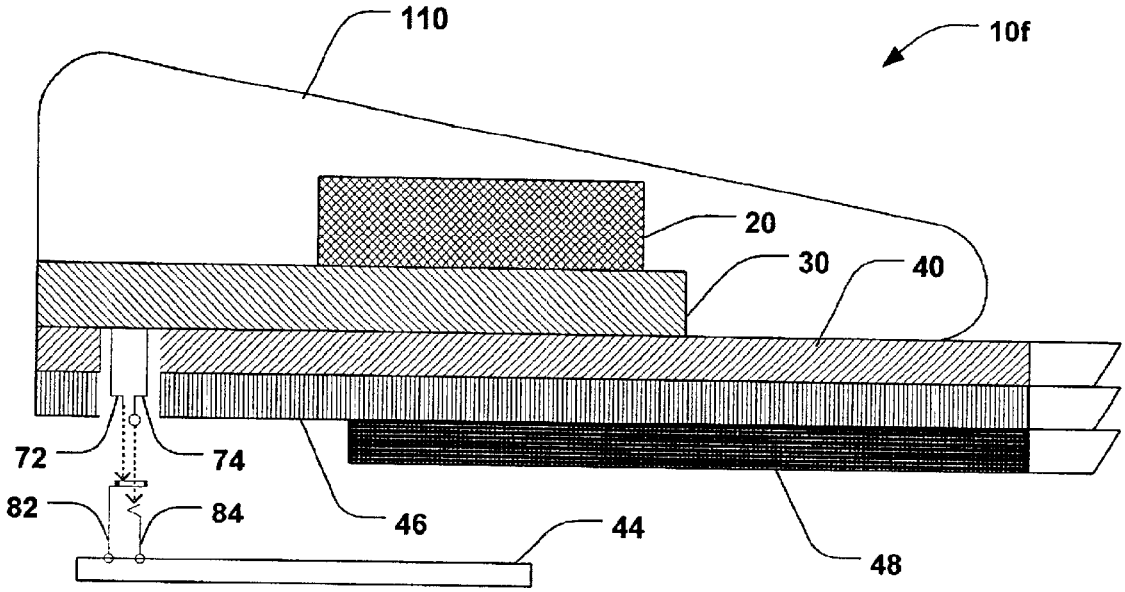
FIG. 6 is a schematic block diagram illustrating a communications and display system with and integrated antenna with a pass-thru connection in accordance with an aspect of the present invention.

Referring now to FIG. 6, a communications system 10*f* illustrates an integrated display system and antenna configuration. A bezel 110 is depicted on top of chip antenna 20 and circuit material 30, and is constructed of a material that generally does not interfere with the signals being received and broadcast by the chip antenna 20. The bezel 110 is employed to conceal and protect chip antenna 20 and circuit material 30. According to this aspect of the present invention, the circuit material 30 is a substantially rigid circuit board, employed in a configuration similar to that described for display system 10*b* in FIG. 2. The location of the chip antenna 20 utilizes the bezel 110 as a protective and aesthetically pleasing barrier while providing for optimal signal strength by placing the chip antenna 20 outside of a communications module housing (not shown) interfacing to the bezel 110. The display 48 is installed in the system such that it does not interfere mechanically with the mating connectors 72,74,82 and 84 or the opening 76 in conductive material 40 and lens material 45. It is to be appreciated that other display configurations are possible. For example, a flexible circuit as depicted in the communications system 10*d* in FIG. 4 may also be employed with the display illustrated in FIG. 6.

Figure 7:
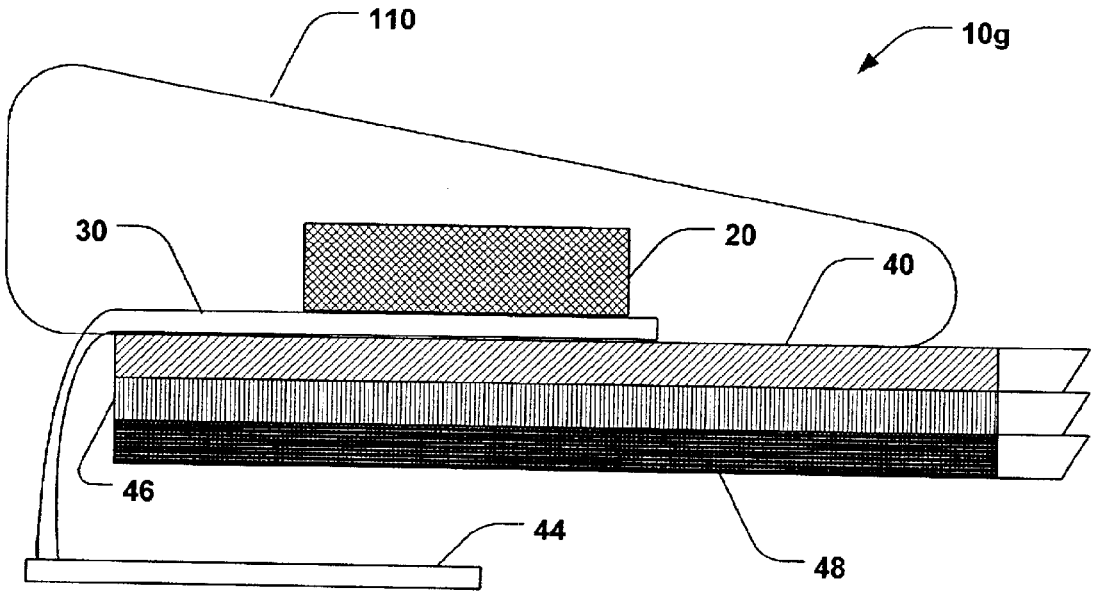
FIG. 7 is a schematic block diagram illustrating a communications and display system with and integrated antenna with a pass-over connection in accordance with an aspect of the present invention.

Referring to FIG. 7, a communications system 10*g* illustrates an alternative integrated display system and antenna configuration. This configuration is similar to that described above for the display system 10*g* with the exception of the placement of chip antenna 20 and circuit material 30 with respect to conductive material 40 and lens material 45. According to this aspect of the invention, the circuit material 30 is mounted such that the flexible circuit connection to the transmitter/receiver subsystem 44 is outside of the outer edge of conductive material 40, lens material 45 and display 48. This enables coupling of the circuit material 30 to transmitter/receiver subsystem 44 without an opening in the conductive material 40 and the lens material 45. It is to be appreciated that other display configurations are possible. For example, a connection as depicted in the communications system 10*c* in FIG. 3 may also be employed with the display illustrated in FIG. 7.

Figure 8:
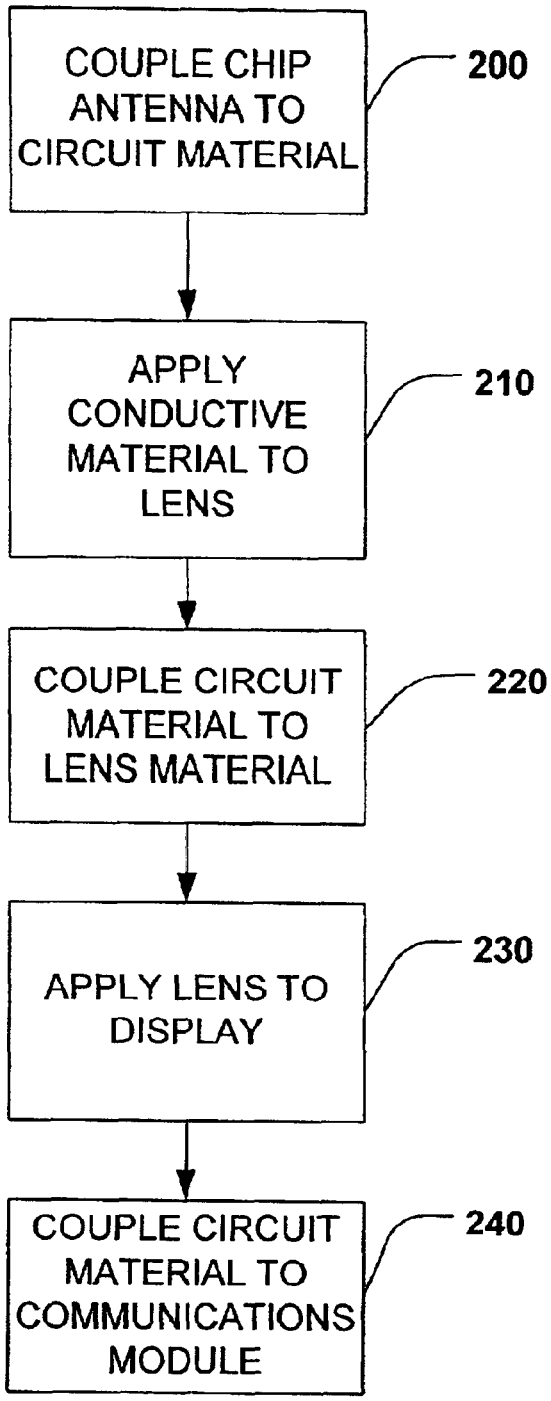
FIG. 8 is a flow diagram illustrating a methodology providing integrated chip and display communications in accordance with the present invention.

FIG. 8 illustrates a methodology for providing an integrated chip antenna and display in accordance with an aspect of the present invention. While, for purposes of simplicity of explanation, the methodology is shown and described as a series of acts, it is to be understood and appreciated that the present invention is not limited by the order of acts, as some acts may, in accordance with the present invention, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the present invention.

Referring now to FIG. 8, a block diagram methodology is provided for carrying out the present invention. At 200, a chip antenna is operatively coupled to a circuit material. At 210, a conductive material is applied to a lens material of a display. As described above, the conductive material should be substantially transparent so as not to obstruct a display. At 220, the circuit material is coupled to the lens material that was coated with the conductive material at 210. As described above, the conductive material provides a suitable ground plane for the chip antenna. This step may be achieved through various techniques, including but not limited to fasteners and adhesives. At 230, the lens material is coupled to a display, wherein information is presented to a user relating to a communications module or subsystem. At 240, the circuit material is coupled to a communications module such as a transmitter/receiver subsystem described above.

What has been described above are various aspects of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A portable communications and display system, comprising:

a chip antenna to transmit and receive RF signals;

a lens material for mounting the chip antenna;

a conductive material for providing a chip antenna ground plane, wherein the conductive material provides an operative coupling between the lens material and the chip antenna; and a communications subsystem that is associated with the lens material and is operatively coupled to the chip antenna for processing the RF signals.

2. The system of claim 1, further comprising a circuit material for coupling the chip antenna to the communications subsystem.

3. The system of claim 2, wherein the circuit material is at least one of a printed circuit board and a flexible circuit material.

4. The system of claim 2, wherein the circuit material is adhesively coupled to the lens material.

5. The system of claim 3, wherein the circuit material is coupled to a display.

6. The system of claim 2, wherein connectors are utilized to couple the circuit material to the communications subsystem.

7. The system of claim 3, wherein the flexible circuit material is utilized to couple the chip antenna to the communications subsystem.

8. The system of claim 5, wherein the circuit material is coupled to the communications subsystem through an opening in at least one of the conductive material, lens material, and display.

9. The system of claim 5, wherein the circuit material is coupled to the communications subsystem by passing over at least one of the conductive material, lens material, and display.

10. The system of claim 1, wherein the conductive material is at least one of a coating, treatment, film and screen mesh.

11. The system of claim 1, wherein the communications subsystem includes at least one of an RF transmitter and receiver.

12. The system of claim 1, wherein the communications subsystem is at least one of a cell-phone, pager, Personal Digital Assistant (PDA), scanner, hand-held computer, and portable computer.

13. The system of claim 1, wherein the lens material is at least one of glass, Plexiglas, and plastic.

14. The system of claim 1, further comprising a bezel to provide protection for the chip antenna.

15. A method providing portable communications and display, comprising:

employing a chip antenna for transmitting and receiving RF signals;

coupling the chip antenna and a lens material via a conductive material applied therebetween to provide a ground plane for the chip antenna;

mounting the chip antenna to the conductive material and lens material; and coupling the chip antenna to a communications subsystem that is associated with the lens material for processing the RF signals.

16. The method of claim 15, further comprising utilizing circuit material for coupling the chip antenna to die communications subsystem.

17. The method of claim 16, wherein the circuit material is at least one of a printed circuit board and a flexible circuit material.

18. The method of claim 16, wherein the circuit material is adhesively coupled to the lens material.

19. The method of claim 16, further comprising coupling the lens material to a display.

20. The method of claim 16, wherein connectors are utilized to couple the circuit material to the communications subsystem.

21. The method of claim 17, wherein the flexible circuit material is utilized to couple the chip antenna to the communications subsystem.

22. The method of claim 15, wherein the conductive material is at least one of a coating, treatment, film and screen mesh.

23. The method of claim 15, wherein the communications subsystem includes at least one of an RF transmitter and receiver.

24. A system providing portable communications and display, comprising:

a chip antenna for transmitting and receiving RF signals for a communication subsystem;

a display for mounting the antenna thereupon; and conductive means for providing a ground plane to the antenna; the conductive means further positioned between the display and the antenna for a coupling therebetween.

25. A portable communications system, comprising:

a chip antenna to at least one of transmit and receive an RF signal;

a transceiver operatively coupled to the chip antenna to process the RF signal; and a lens material with a conductive coating positioned between the lens material and the chip antenna to provide a chip antenna ground plane that processes RF signals.

26. The system of claim 25, wherein the coating is at least one of a transparent and a translucent material.

* * * * *